US005520456A

United States Patent [19]

Bickerstaff

[11] Patent Number: 5,520,456

[45] Date of Patent: May 28, 1996

[54] APPARATUS FOR HOMOGENEOUS MIXING OF TWO MEDIA HAVING AN ELONGATED CYLINDRICAL PASSAGE AND MEDIA INJECTION MEANS

[76] Inventor: Richard D. Bickerstaff, c/o BlenTech, Inc., 112 Buckingham Rd., Mars, Pa. 16046

[21] Appl. No.: 373,726

[22] Filed: Jan. 17, 1995

Related U.S. Application Data

[63] Continuation of Ser. No. 79,067, Jun. 16, 1993, abandoned.

[51] Int. Cl.[6] ..... B01F 5/20; B01F 15/02

[52] U.S. Cl. ..... 366/137.1; 366/178.2; 239/426; 239/434; 261/79.2

[58] Field of Search ..... 366/107, 150, 366/154, 162, 165, 167, 173, 177, 178, 181, 184, 137.1, 178.1, 178.2, 181.6; 222/129.1, 145; 239/426, 429, 434, 587.1; 261/18.1, 79.1, 79.2, 118, 122.1, DIG. 75; 55/235, 238

[56] References Cited

U.S. PATENT DOCUMENTS

| | | | |
|---|---|---|---|
| 488,624 | 12/1892 | Brewster | 239/587.1 X |
| 582,813 | 5/1897 | Dillon | 261/118 X |
| 723,531 | 3/1903 | Jackson | 261/118 |
| 917,561 | 4/1909 | Double | 261/118 |
| 968,456 | 8/1910 | Edwards | 261/79.2 X |
| 1,511,749 | 10/1924 | Powell | 261/118 |
| 1,724,916 | 8/1929 | Ehrhart | 261/118 |
| 1,734,677 | 11/1929 | Kreisinger | 261/79.2 |
| 1,758,983 | 5/1930 | Seymour | 261/79.2 |
| 2,097,158 | 10/1937 | Joos | 261/118 |
| 2,746,728 | 5/1956 | Pomerleau | 366/137.1 X |
| 2,797,904 | 7/1957 | Voorheis | 261/118 X |
| 3,009,687 | 11/1961 | Hendriks | 261/118 X |
| 3,324,632 | 6/1967 | Berneike et al. | 261/79.2 X |
| 3,343,822 | 9/1967 | McCune | 261/118 |
| 3,554,228 | 1/1971 | Schneider . | |
| 3,765,317 | 10/1973 | Lowe | 239/587.1 X |
| 3,819,157 | 6/1974 | Markfelt . | |
| 4,054,424 | 10/1977 | Staudinger et al. | 261/79.2 X |
| 4,110,973 | 9/1978 | Haeflich et al. | 261/118 X |
| 4,212,835 | 7/1980 | Koros | 261/118 X |
| 4,474,477 | 10/1984 | Smith et al. | 366/165 |
| 4,643,582 | 2/1987 | Ricciardi | 366/178 X |
| 4,647,212 | 3/1987 | Hankison . | |
| 4,761,077 | 8/1988 | Werner | 366/165 |
| 4,828,768 | 5/1989 | Talmor | 261/DIG. 75 X |
| 4,886,369 | 12/1989 | Hankison . | |
| 5,004,484 | 4/1991 | Stirling et al. . | |
| 5,017,201 | 5/1991 | Park | 261/79.2 X |
| 5,131,757 | 7/1992 | Smith | 261/118 X |

FOREIGN PATENT DOCUMENTS

| | | | |
|---|---|---|---|
| 2199259 | 7/1988 | United Kingdom | 261/118 |

*Primary Examiner*—Charles E. Cooley

*Attorney, Agent, or Firm*—Walter J. Blenko, Jr.; Eckert Seamans Cherin & Mellott

[57] ABSTRACT

Mixing apparatus having an elongated cylindrical passage for flow of a fluid therethrough, nozzles for injection of a medium into the passage, and a funnel to inject a second medium into an end of the passage for travel through the passage and mixing of the first medium and the second medium in the passage.

2 Claims, 2 Drawing Sheets

APPARATUS FOR HOMOGENEOUS MIXING OF TWO MEDIA HAVING AN ELONGATED CYLINDRICAL PASSAGE AND MEDIA INJECTION MEANS

This application is a continuation of my application Ser. No. 08/079,067 filed Jun. 16, 1993, now abandoned.

BACKGROUND OF THE INVENTION

This application relates to mixing of a first medium with a second medium to obtain an evenly dispersed and homogeneous mixture of the two media. More particularly, it relates to introducing one medium into a moving stream of a second medium in a passage.

The blending and mixing of different media is a common industrial practice. In many instances, however, the actual operation of mixing the two media is difficult, time consuming, and expensive. For example, introducing a diluent into a slurry may leave excess concentrations of diluent in some parts and excess concentrations of slurry in other parts. While the macro proportions may be as desired, the mixture is not homogeneous. If a particulate material is to be mixed with a fluid, a common problem is that the particulate material may be agglomerated instead of being uniformly distributed throughout the fluid.

SUMMARY OF THE INVENTION

I provide a mixing apparatus comprising a passage formed by a surrounding wall, a first medium chamber on the opposite side of the wall from the passage, a first medium inlet to the chamber, and nozzle means positioned in the wall and extending between the first medium chamber and the passage for dispersion of the first medium into the passage. I further provide a second medium outlet positioned adjacent one end of the passage for introduction of a second medium into the passage. Preferably, I place the entire apparatus within a larger container and provide inlet and outlet means for introduction of a fluid stream, e.g. air, into the container through the passage and then out of the container.

I prefer to provide a toroidal member having an inner chamber and forming a passage through the center of the toroidal member. I provide a first medium inlet through the interior of the toroidal member. I prefer to provide a plurality of nozzles positioned in the interior wall of the toroidal member and directed toward a passage which is formed and surrounded by the toroidal member. I further provide means for introducing a second medium into the passage through the center of the toroidal member. I prefer to provide a funnel-like member having spaced- apart inner and outer walls which form as a second medium chamber for introduction of the second medium into the throat of the funnel.

I may provide a toroidal member which has been extended axially thereby providing an elongated passage within which mixing may take place. I prefer to provide a surrounding container having an inlet for a fluid to pass through the center of the toroidal member and an outlet for passage of a fluid from the container.

Other details, objects, and advantages of my invention will become more apparent as the following description of certain present preferred embodiments thereof proceeds.

BRIEF DESCRIPTION OF THE DRAWINGS

In the accompany drawings, I have illustrated certain present preferred embodiments of my invention in which.

DESCRIPTION OF THE PREFERRED EMBODIMENTS

Figure 1:
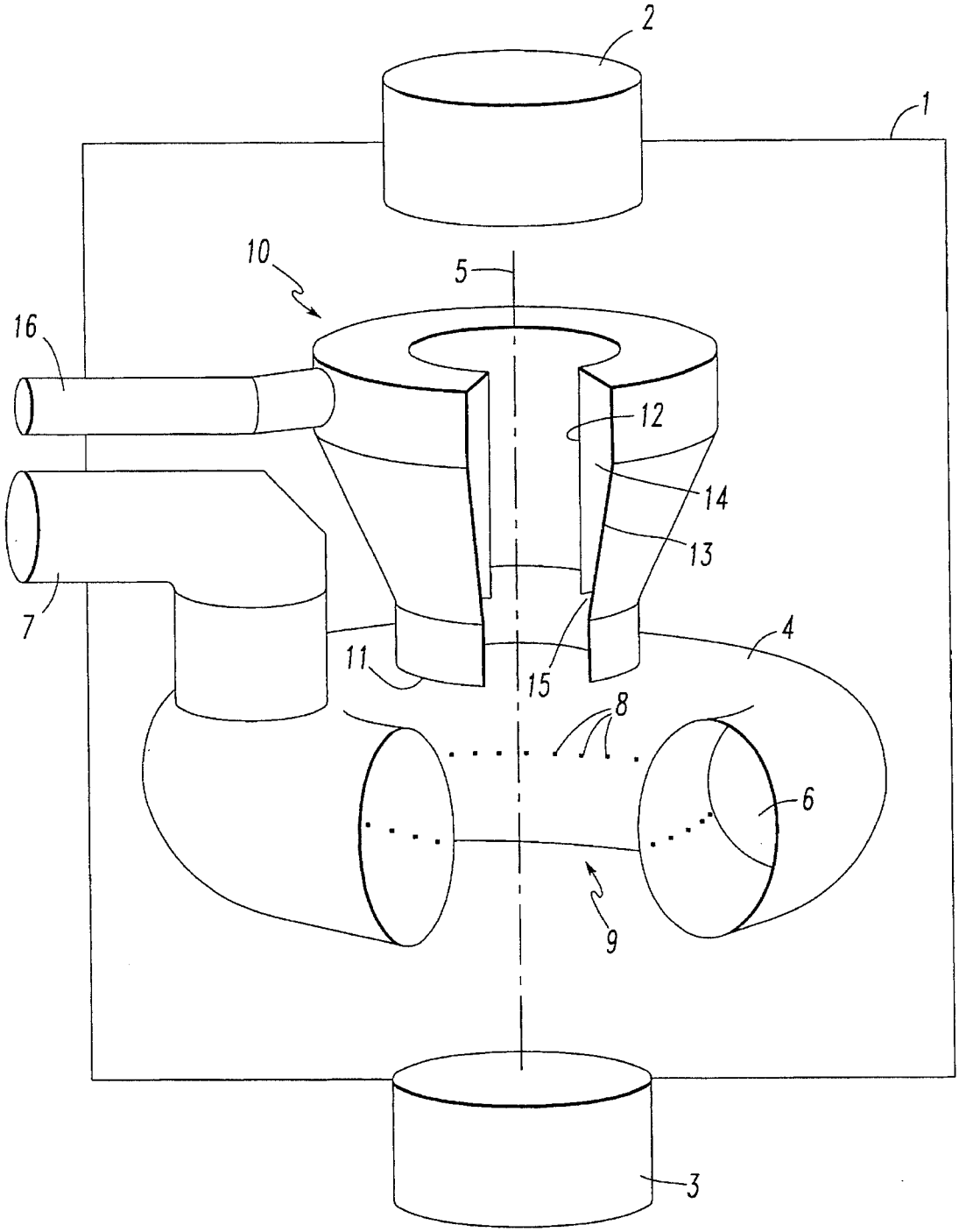
FIG. 1 is a schematic illustration of a toroidal member arranged for mixing of one medium with another.

A container 1 is shown schematically in FIG. 1. An inlet 2 is provided for introduction of a fluid into the container, and an outlet 3 is provided for escape of fluid from the container. A toroidal member 4 is positioned within the container and is symmetrical about an axis 5 which extends from inlet 2 to outlet 3. The interior of the toroidal member forms a first medium chamber 6. A conduit 7 connects from a source of supply outside container 1 to chamber 6 and serves as a first medium inlet to introduce a medium to be mixed into chamber 6. A plurality of nozzles 8 are positioned on the inner surface of the toroid extending between chamber 6 and a passage 9. The nozzles may be directed radially inward, or they may be directed up or down or tangentially, either as a group or selectively.

A funnel 10 is mounted above toroidal member 4 with the throat 11 of funnel 10 being placed adjacent one end of passage 9. The funnel comprises spaced apart inner and outer walls 12 and 13 which form a second medium chamber 14 therebetween. Medium chamber 14 is opened at the bottom forming an outlet 15 between walls 12 and 13. A conduit 16 connects to medium chamber 14 from a source of supply and conveys a second medium to chamber 14.

Figure 2:
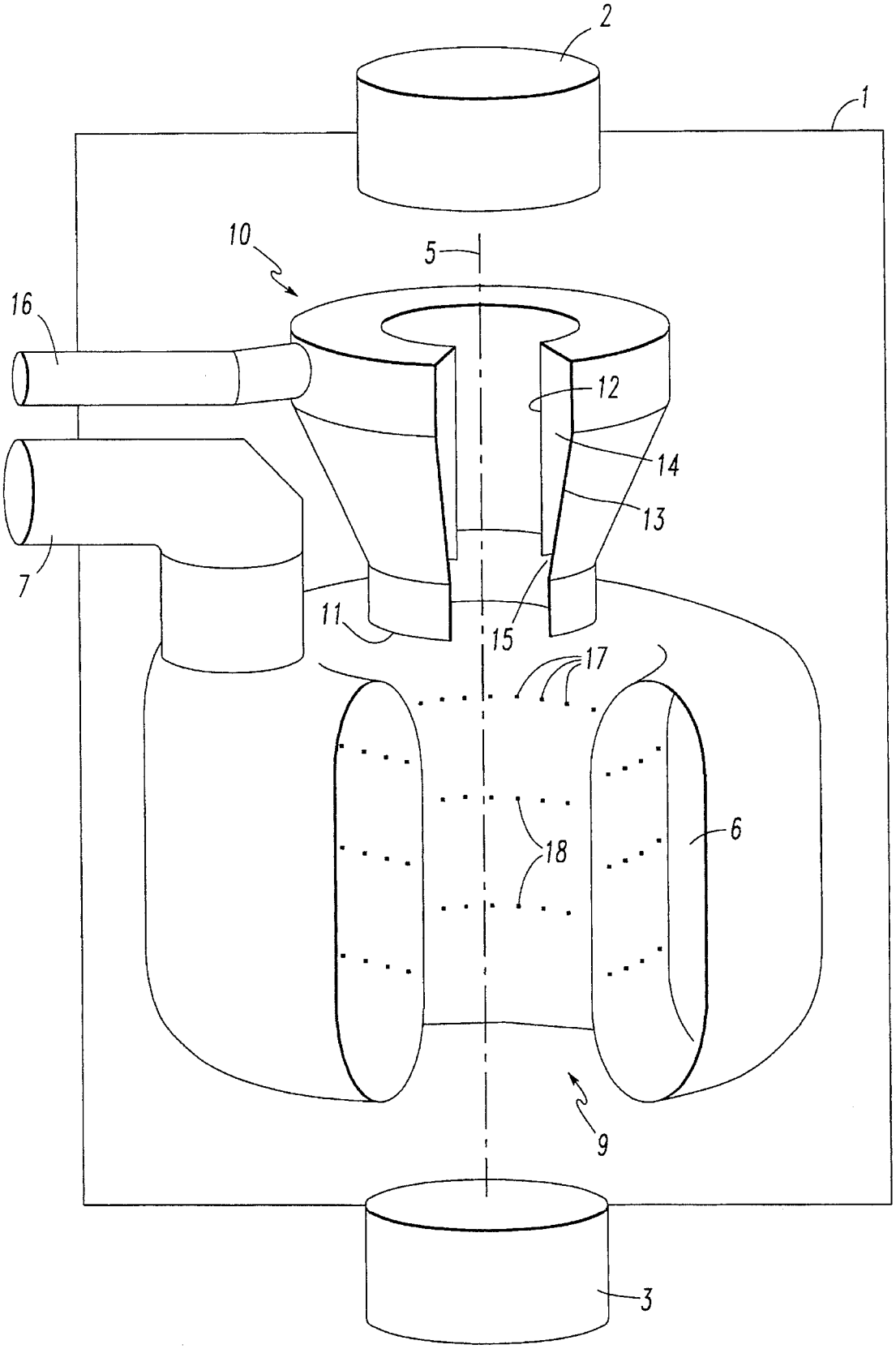
FIG. 2 is a schematic illustration similar to FIG. 1 in which the toroidal member has been extended axially and is shown without the surrounding container.

FIG. 2 shows a modified form of toroidal member in which the cross section instead of being circular is extended with rounded ends and slightly curved sides similar to a rectangle with rounded ends. The passage 9 which is defined by the space surrounded by the toroidal member is longer than in the structure of FIG. 1. Moreover, three rows of nozzles 17, 18, and 19 are provided extending between medium chamber 6 and passage 9.

The elongated toroidal member may be surrounded by a chamber similar to that of FIG. 1 but the chamber has been omitted from FIG. 2 for simplicity of illustration.

In operation of the apparatus of FIG. 1, a first medium is introduced through conduit 7 into chamber 6 and then is dispersed through nozzles 8 into passage 9. A second medium is introduced through conduit 16 to chamber 14, and then passes through outlet 15 from which the medium passes through passage 9. There it is mixed with the first medium being dispersed from nozzles 8. The flow of the two media into and through passage 9 may optionally be enhanced by delivery of a fluid from inlet 2 through funnel 10 and passage 9 through outlet 3.

The form of the apparatus shown in FIG. 2 is similar in all material respects to that shown in FIG. 1 except that the toroidal member is elongated axially, and a plurality of rows of nozzles are provided along an extended passage which is formed by the toroidal member.

The apparatus provides enhanced mixing of difficult to handle substances, such as two fluids and a fluid or a solid or two solids. An example of a commercial application is the mixing of tomato paste and water to form a dilute tomato paste which is fully homogenized and blended without further processing being required. An invention may be utilized to mix particulate materials into a fluid in a finely dispersed manner to avoid layering or flocculation of the solid materials.

While I have illustrated and described certain present preferred embodiments of my intention, it is to be understood that the invention is not limited thereto and may be otherwise variously practiced within the scope of the following claims.

I claim:

1. Apparatus for homogeneous mixing of two media comprising an axially extended toroidal member having an interior wall which forms a generally cylindrical elongated passage which is aligned with the central axis of the toroidal member, and which toroidal member has an inlet end and an outlet end, a chamber within the toroidal member which surrounds the passage, a first medium inlet to the chamber within the toroidal member, a plurality of rows of nozzles positioned in the interior wall of the toroidal member and directed toward the passage formed by and surrounded by the toroidal member, funnel means comprising spaced apart inner and outer walls and enclosing a space therebetween, a second medium inlet to the space enclosed by the funnel walls, a second medium outlet from the enclosed space adjacent the lower end of the funnel, the lower end of the funnel being placed at one end of the passage aligned with the central axis of the toroidal member.

2. The mixing apparatus of claim 1 having a surrounding container.

* * * * *